US005154685A

United States Patent [19]

Chen

[11] Patent Number: 5,154,685

[45] Date of Patent: Oct. 13, 1992

[54] SPRING-TYPE BODY EXERCISER

[76] Inventor: Ping Chen, No. 29, Nan-Mei St., Nan-Tun Dist., Taichung City, Taiwan

[21] Appl. No.: 802,237

[22] Filed: Dec. 4, 1991

[51] Int. Cl.[5] ..... A63B 21/02

[52] U.S. Cl. ..... 482/126; 482/121; 482/127

[58] Field of Search ..... 482/126, 128, 122, 123, 482/49, 121, 125, 129, 139, 116, 117, 908, 909

[56] References Cited

U.S. PATENT DOCUMENTS

| | | | |
|---|---|---|---|
| 1,023,756 | 4/1912 | Pons | 482/126 |
| 2,106,994 | 2/1938 | Chapman | 482/126 |
| 2,223,309 | 11/1940 | Swanson | 482/123 |
| 3,029,076 | 4/1962 | Andersen | 482/128 |
| 3,228,392 | 1/1966 | Speyer | 482/122 |
| 3,447,415 | 6/1969 | Kime | 482/128 |
| 4,351,527 | 9/1982 | Crisp | 482/122 |
| 4,842,273 | 6/1989 | Schmeiss | 482/126 |
| 5,046,726 | 9/1991 | Van Straater | 482/128 |
| 5,071,119 | 12/1991 | Johnson | 482/128 |

*Primary Examiner*—Richard J. Apley
*Assistant Examiner*—Jerome Donnolly
*Attorney, Agent, or Firm*—Beveridge, DeGrandi & Weilacher

[57] ABSTRACT

A spring-type body exerciser includes a stationary part and a movable part having an inner tube telescopically extending into a tubular member of the stationary part. The inner tube has an axially extending slot formed adjacent to a top end thereof. A push piece is mounted on the top end of the inner tube. A threaded shaft extends through the push piece and into the inner tube. A tubular adjustment sleeve has a threaded portion engaging the threaded shaft and a radial projection extending into the slot of the inner tube. The adjustment sleeve is provided inside the inner tube. A spring member is provided inside the tubular member and has a first end connected to the tubular member and a second end connected to the adjustment sleeve. The spring member biases the inner tube to extend normally out of the tubular member. The spring member resists a pushing force applied on the push piece so as to retract the inner tube into the tubular member. The threaded shaft is turned so as to move the adjustment sleeve along the threaded shaft and thereby adjust the force of the spring member so as to suit the user's needs.

8 Claims, 6 Drawing Sheets

SPRING-TYPE BODY EXERCISER

BACKGROUND OF THE INVENTION

1. Field of the Invention

The invention relates to a simple body exerciser which can be used to exercise the arms, the abdominal portion and the waist portion in one's household, more particularly to a spring-type body exerciser having provisions for adjusting the resistance offered by the same.

2. Description of the Related Art

Presently, there is available a compression spring-type body exerciser which can be used to exercise the arms, the waist portion and the abdominal portion in one's household. The conventional compression spring-type body exerciser comprises a stationary part including a tubular member which is held in place between the user's thighs. An inner tube telescopically extends into the tubular member and is biased by a compression spring disposed inside the tubular member to extend normally out of the tubular member. The user's hands grasp a pair of handlebars on a push piece mounted on the top end of the inner tube. The user then exerts a pushing force on the push piece so as to retract the inner tube into the tubular member and thus compress the compression spring. The compression spring expands to restore the inner tube to the normal position when the applied pushing force is relaxed.

A main drawback of the conventional compression spring-type body exerciser is that the force of the compression spring cannot be adjusted to suit the user's needs.

SUMMARY OF THE INVENTION

Therefore, the main objective of the present invention is to provide a spring-type body exerciser having provisions for adjusting the resistance offered by the same.

Accordingly, the preferred embodiment of a spring-type body exerciser of the present invention comprises:

a stationary part including a tubular member;

a movable part including: an inner tube telescopically extending into the tubular member and having an axially extending slot formed adjacent to a top end thereof; a push piece mounted on the top end of the inner tube; and a resistance adjusting means, which includes a threaded shaft extending through the push piece and into the inner tube and a tubular adjustment sleeve having a threaded portion engaging the threaded shaft and a radial projection extending into the slot of the inner tube, said adjustment sleeve being provided inside the inner tube; and a spring member provided inside the tubular member and having a first end connected to the tubular member and a second end connected to the adjustment sleeve, said spring member biasing the inner tube to extend normally out of the tubular member, and said spring member resisting a pushing force applied on the push piece so as to retract the inner tube into the tubular member;

said threaded shaft being turnable so as to move the adjustment sleeve along the threaded shaft to adjust the force of the spring member.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
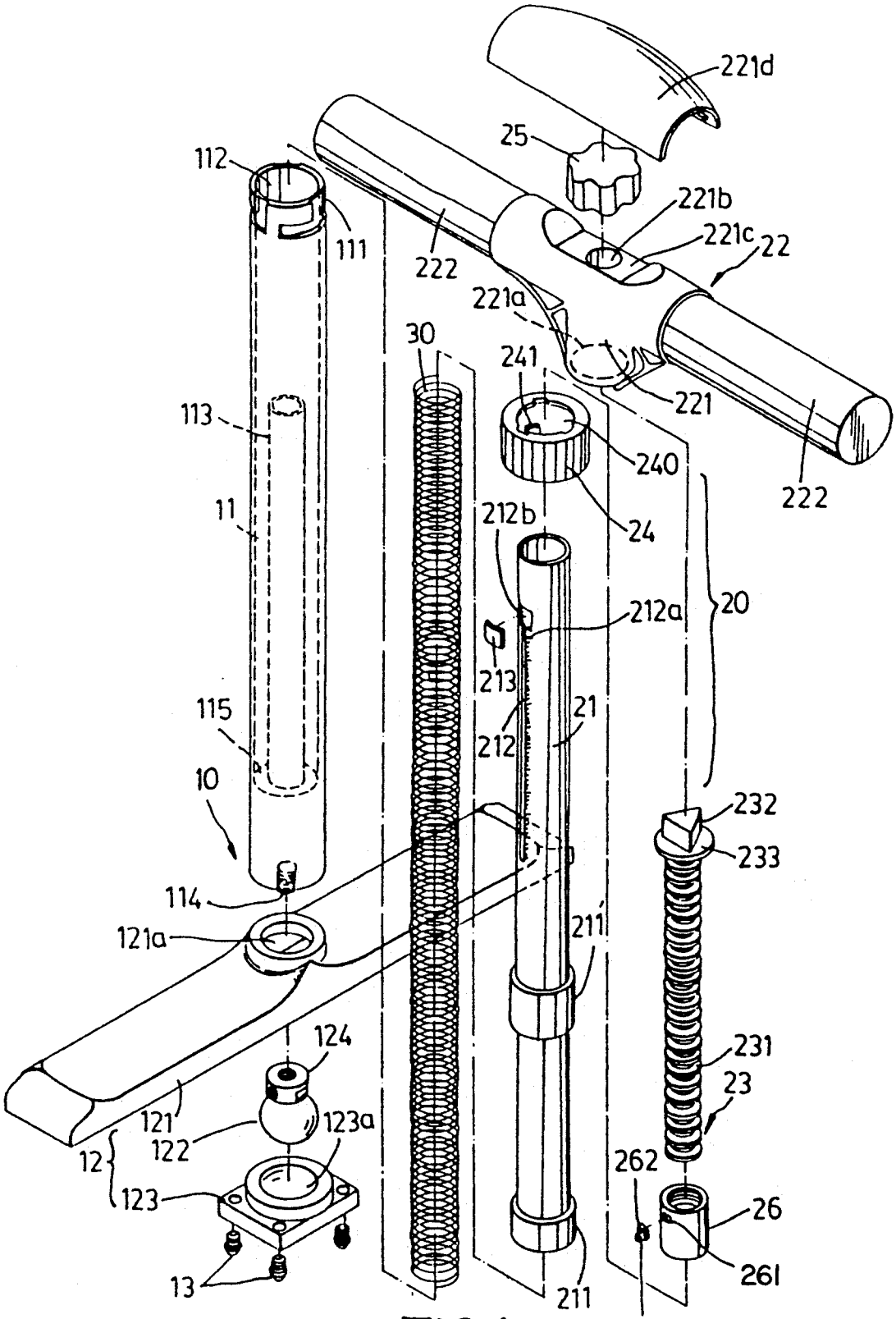
FIG. 1 is an exploded view of the first preferred embodiment of a spring-type body exerciser according to the present invention.
Figure 2:
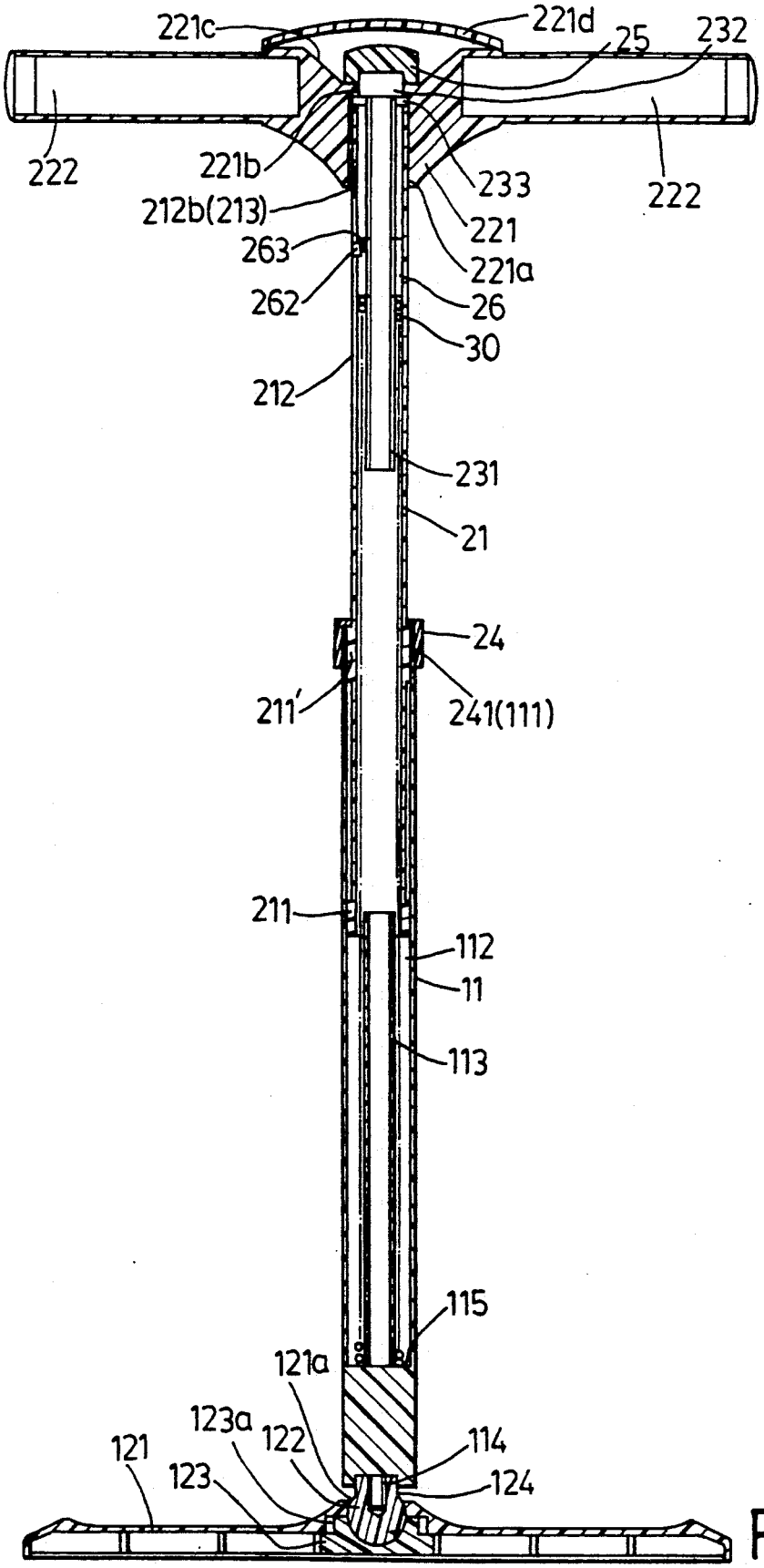
FIG. 2 is a sectional view of the first preferred embodiment illustrating its assembly.

Referring to FIGS. 1 and 2, the first preferred embodiment of a spring-type body exerciser according to the present invention is shown to comprise a stationary part (10) and a movable part (20).

The stationary part (10) includes a tubular member (11) and a stationary unit (12). The top end of the tubular member (11) has an outer surface formed with a plurality of L-shaped engaging grooves (111). The tubular member (11) defines an axial receiving space (112). The tubular member (11) has a closed bottom (115) and an axial hollow shaft (113) extending from the closed bottom (115) and into the receiving space (112). A helical compression spring (30) is disposed inside the receiving space (112) around the hollow shaft (113). The tubular member (11) is further provided with an axial bolt (114) which extends downwardly from the closed bottom (115).

The stationary unit (12) includes an elongated positioning member (121). The central portion of the positioning member (121) is formed with an opening (**121*a*). The periphery defining the opening (121*a*) curves upwardly and inwardly. A ball joint, which includes a ball member (122) and a socket member (123), is provided to mount the tubular member (11) onto the positioning member (121). The socket member (123) has a concave depression (123*a*) to receive a portion of the ball member (122). The ball member (122) has a threaded bore (124) to receive the bolt (114). This illustrates how the tubular member (11) is pivotably mounted on the stationary unit (12**).

The movable part (20) includes an inner tube (21), a push piece (22) and a resistance adjusting means (23).

The inner tube (21) telescopically extends into the receiving space (112) around the compression spring (30). The inner tube (21) has two spaced annular shoulders (211, 211') which are in sliding contact with the internal surface of the tubular member (11). An axially extending slot (212) is formed adjacent to the top end of the inner tube (21). The inner tube (21) is further formed with graduations (**212*a*) which are disposed adjacent to the slot (212). The graduations (212*a*) are used to indicate the magnitude of the spring force exerted by the compression spring (30). The top end of the slot (212) is formed with a larger open section (212*b*). A curved plate (213) is used to cover the open section (212*b*). The inner tube (21) extends through an opening (240) formed on the top end of a cap (24). The inner surface of the cap (24**) is formed with engaging projections (241) which connect with the engaging grooves (111) at the top end of the tubular member (11).

The push piece (22) has a connector portion (221) and a pair of lateral handlebars (222) extending from two sides of the connector portion (221). The bottom end of the connector portion (221) is formed with an upright opening (221*a*) with a threaded portion to engage the top end of the inner tube (21). The opening (221*a*) is further provided with a restricted portion (221*b*) at the top end thereof. The connector portion (221) has a top end formed with an indentation (221*c*). A curved cover plate (221*d*) is provided to cover the indentation (221*c*).

The resistance adjusting means (23) includes a threaded shaft (231) extending through the upright opening (221*a*). The top end of the threaded shaft (231) is provided with a triangular mounting plug (232) which extends through the restricted portion (221*b*) and into the indentation (221*c*). A control knob (25) is disposed inside the indentation (221*c*) and is connected to the mounting plug (232). The top end of the shaft (231) is further provided with a control flange (233) which abuts the periphery defining the restricted portion (221*b*). An adjustment sleeve (26) has a threaded portion which engages the shaft (231). The adjustment sleeve (26) is to be provided inside the inner tube (21). The top end of the compression spring (30) abuts the lower end of the adjustment sleeve (26). The adjustment sleeve (26) is provided with a radial notch (261). A control piece (262) is attached to the adjustment sleeve (26) at the radial notch (261). The control piece (262) has a projection (263) which extends into the slot (212). The projection (263) prevents rotation of the adjustment sleeve (26) with the inner tube (21) but permits movement of the adjustment sleeve along the shaft (231).

Assembly of the first preferred embodiment is as follows: The ball member (122) of the stationary unit (12) is first secured to the bolt (114) of the tubular member (11). The tubular member (11) is thus pivoted on the stationary unit (12) to permit positioning of the tubular member (11) at different angles relative to the stationary unit (12). The adjustment sleeve (26) is secured on the shaft (231). The cap (24) is then sleeved on the inner tube (21) and is supported by the annular shoulder (211'). The shaft (231) is inserted into the inner tube (21). The radial notch (261) of the adjustment sleeve (26) is initially aligned with the larger open section (212*b*) of the slot (212). The control piece (262) is then attached to the adjustment sleeve (26) at the radial notch (261). The projection (263) is then maneuvered so as to extend into the slot (212). The curved plate (213) is then provided to cover the open section (212*b*). The top end of the inner tube (21) engages the connector portion (221) at the upright opening (221*a*) of the latter. The control knob (25) is then secured to the mounting plug (232) of the shaft (231). The compression spring (30) is provided inside the receiving space (112) of the tubular member (11) around the hollow shaft (113). After the movable part (20) has been assembled, the inner tube (21) is provided inside the receiving space (112) such that the compression spring (30) is disposed inside the inner tube (21) and the top end of the compression spring (30) abuts the lower end of the adjustment sleeve (26). The cap (24) is then secured to the top end of the tubular member (11). The cover plate (221*d*) is then provided to cover the indentation (221*c*) of the connector portion (221). Note that the compression spring (30) biases the inner tube to extend normally out of the tubular member (11).

Figure 3:
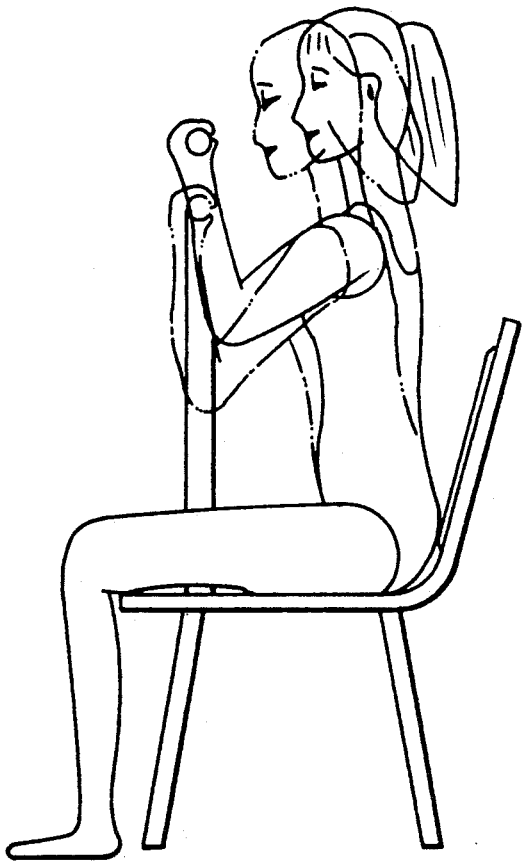
FIG. 3 is an illustration of the spring-type body exerciser of the present invention when in use.

FIG. 3 is an illustration of the spring-type body exerciser of the present invention when in use. The user is preferably in a sitting position. The user's thighs are seated on the stationary unit (12), and the tubular member (11) extends between the user's thighs. The user's hands grasp the handlebars (222) of the push piece (22). The pushing force which is exerted from the user's arms, in combination with those from the abdominal portion and the waist portion, retracts the inner tube (21) into the tubular member (11) so as to compress the compression spring (30). This illustrates how exercising of the arms, the abdominal portion and the waist portion can be achieved with the use of the preferred embodiment.

The preceding paragraph illustrates the operation of the preferred embodiment when the user exerts a first force to compress the compression spring (30). Note that the compression spring (30) generates an oppositely-directed expanding force whenever the compression spring (30) is compressed. The user can thus exert a second force so as to control the compression spring (30) to expand gradually. This illustrates the two kinds of exercise movements offered by the spring-type body exerciser of the present invention.

Figure 4:
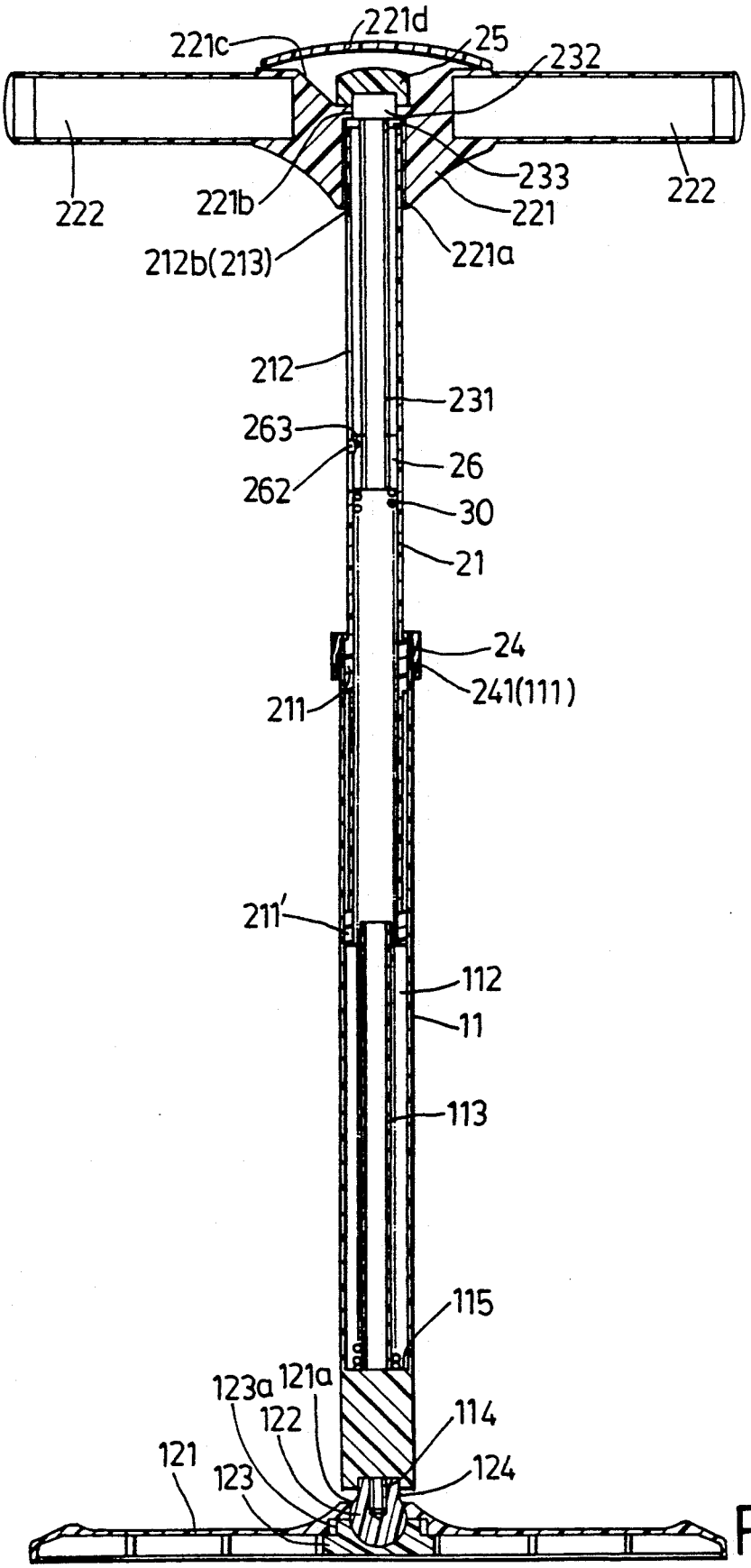
FIG. 4 illustrates the resistance adjustment operation of the first preferred embodiment.

FIG. 4 illustrates the resistance adjusting operation of the preferred embodiment. The cover plate (221*d*) is moved to the open position, and the control knob (25) is rotated to turn the shaft (231). The projection (263) of the control piece (262) on the adjustment sleeve (26) extends into the slot (212) of the inner tube (21) to prevent rotation of the adjustment sleeve (26) with the shaft (231). Clockwise rotation of the shaft (231) can thus cause downward movement of the adjustment sleeve (26) along the shaft (231). The compression spring (30) is compressed and can thus have a greater reserved expanding force. When the shaft (231) is rotated in a counterclockwise direction, the adjustment sleeve (26) moves upward along the shaft (231) to cause expansion of the compression spring (30) and thus reduce the reserved expanding force of the compression spring (30). This illustrates how the resistance offered by the spring-type body exerciser of the present invention can be adjusted according to the user's needs in order to minimize the occurrence of injury.

Figure 5:
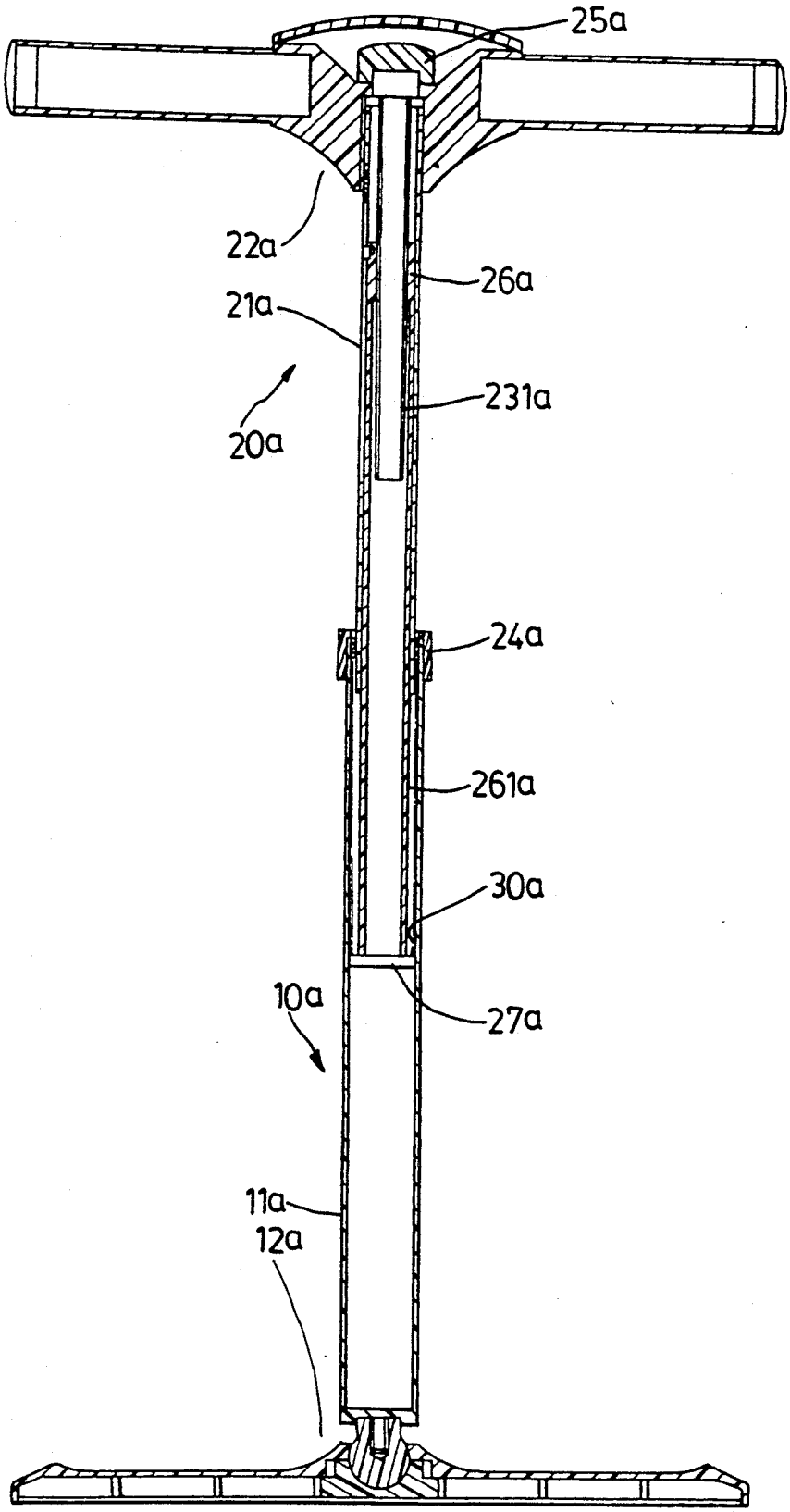
FIG. 5 is an illustration of the second preferred embodiment of a spring-type body exerciser according to the present invention.
Figure 6:
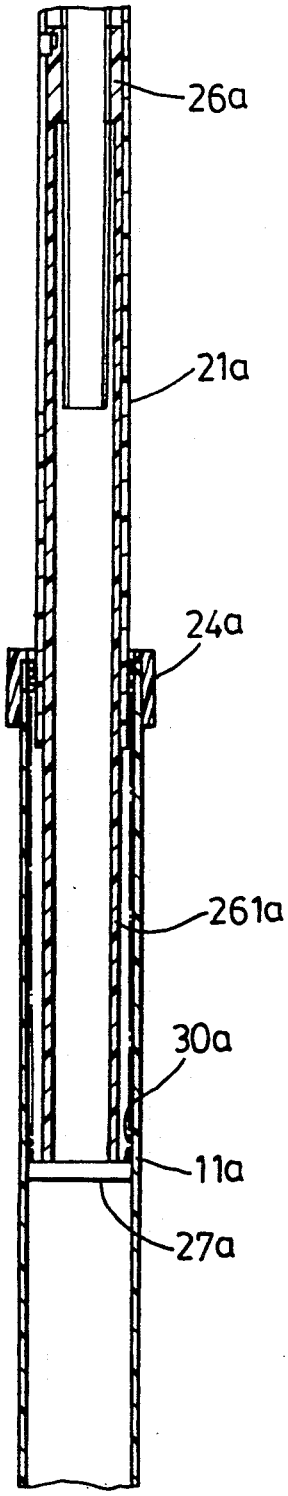
FIG. 6 is an enlarged view of the central portion of the spring-type body exerciser shown in FIG. 5.

Referring to FIGS. 5 and 6, the second preferred embodiment of a spring-type body exerciser according to the present invention is shown to comprise a stationary part (10*a*) and a movable part (20*a*). The stationary part (10*a*) includes a tubular member (11*a*) having a bottom end pivotably mounted to a stationary unit (12*a*). The movable part (20*a*) includes an inner tube (21*a*) extending into the tubular member (11*a*) and a push piece (221*a*) provided on a top end of the inner tube (21*a*). As with the first preferred embodiment, a threaded shaft (231*a*) extends inside the inner tube (21*a*), and an adjustment sleeve (26*a*) has a threaded portion which engages the shaft (231*a*). The adjustment sleeve (26*a*) further has an axial tube portion (261*a*) extending downward past the lowermost end of the inner tube (21*a*). A support plate (27*a*) is provided on the distal end of the tube portion (261*a*) and is in sliding contact with the inner surface of the tubular member (11*a*). An extension spring (30*a*) has a bottom end secured on the support plate (27*a*) and a top end secured to a cap (24*a*) mounted on the upper end of the tubular member (11*a*). The extension spring (30*a*) should be disposed around the tube portion (261*a*). When force is exerted so as to move the push piece (22*a*) downward, the inner tube (21*a*) is retracted into the tubular member (11*a*) so as to produce a pulling action on the extension spring (30*a*).

The procedure for adjusting the resistance offered by the second preferred embodiment is substantially similar to that of the first preferred embodiment and will not be detailed further. A control knob (25*a*) is operated to turn the shaft (231*a*) and cause upward or downward movement of the adjustment sleeve (26*a*) along the shaft (231*a*). The degree of tension of the extension spring (30*a*) is varied so as to adjust the resistance offered by the spring-type body exerciser.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A spring-type body exerciser, comprising:

a stationary part including a tubular member;

a movable part including: an inner tube telescopically extending into said tubular member and having an axially extending slot formed adjacent to a top end thereof; a push piece mounted on said top end of said inner tube; and a resistance adjusting means which includes a threaded shaft extending through said push piece and into said inner tube, and a tubular adjustment sleeve having a threaded portion engaging said threaded shaft and a radial projection extending into said slot of said inner tube, said adjustment sleeve being provided inside said inner tube; and a spring member provided inside said tubular member and having a first end connected to said tubular member and a second end connected to said adjustment sleeve, said spring member biasing said inner tube to extend normally out of said tubular member, and said spring member resisting a pushing force applied on said push piece so as to retract said inner tube into said tubular member;

said threaded shaft being turnable so as to move said adjustment sleeve along said threaded shaft and adjust the force of said spring member.

2. The spring-type body exerciser as claimed in claim 1, wherein said stationary part further comprises a stationary unit including an elongated positioning member, said tubular member having a closed bottom mounted on a central portion of said positioning member.

3. The spring-type body exerciser as claimed in claim 2, wherein said stationary part further comprises a ball joint pivotably mounting said closed bottom of said tubular member onto said positioning member.

4. The spring-type body exerciser as claimed in claim 1, wherein said tubular member defines an axial receiving space, and said tubular member having a closed bottom and an axial hollow shaft extending from said closed bottom and into said receiving space; said spring member being a compression spring disposed inside said receiving space around said hollow shaft, said first end of said spring member being connected to said closed bottom of said tubular member, and said second end of said spring member extending into said inner tube so as to connect with said adjustment sleeve.

5. The spring-type body exerciser as claimed in claim 1, wherein said inner tube is further provided with graduations disposed adjacent to said slot and being used to indicate the magnitude of the force exerted by said spring member.

6. The spring-type body exerciser as claimed in claim 1, wherein said push piece includes a connector portion and a pair of lateral handlebars extending from two sides of said connector portion; said connector portion being mounted to said top end of said inner tube; said threaded shaft having a top end extending upwardly through said connector portion; and said resistance adjusting means further comprising a control knob disposed on a top end of said connector portion and being connected to said top end of said threaded shaft, said control knob being operated so as to turn said threaded shaft.

7. The spring-type body exerciser as claimed in claim 6, wherein said top end of said connector portion is formed with an indentation; said control knob is disposed in said indentation; and said push piece further includes a curved cover plate to cover said indentation.

8. The spring-type body exerciser as claimed in claim 1, wherein:

said adjustment sleeve has an axial tube portion extending downward past a bottom end of said inner tube, said tube portion having a distal end provided with a support plate in sliding contact with an internal surface of said tubular member; and said spring member being an extension spring disposed around said tube portion, said first end of said spring member being connected to a top end of said tubular member, and said second end of said spring member being connected to said support plate.

* * * * *